US007445128B2

(12) United States Patent
Kaczmarek

(10) Patent No.: US 7,445,128 B2
(45) Date of Patent: Nov. 4, 2008

(54) CUTLERY BASKET FOR A DISHWASHER

(75) Inventor: Wolfgang Kaczmarek, Schwindegg (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 459 days.

(21) Appl. No.: 10/879,928

(22) Filed: Jun. 28, 2004

(65) Prior Publication Data

US 2005/0028847 A1 Feb. 10, 2005

Related U.S. Application Data

(63) Continuation of application No. PCT/EP02/13253, filed on Nov. 25, 2002.

(30) Foreign Application Priority Data

Dec. 28, 2001 (DE) ..... 101 64 505

(51) Int. Cl.
*A47G 19/08* (2006.01)

(52) U.S. Cl. ..... 211/41.8; 211/41.5; 211/150

(58) Field of Classification Search ..... 211/41.1, 211/41.5, 41.6, 41.8, 181.1, 70.7, 90.01, 211/85.31, 193, 133.5, 149, 169.1, 150, 90.03, 211/81, 126.6, 126.9, 130.1, 132.1, 126.15, 211/85.25, 88.01, 88.02; 108/42, 109, 106, 108/193, 147.11, 147.16; 312/351
See application file for complete search history.

(56) References Cited

U.S. PATENT DOCUMENTS

| | | | | | |
|---|---|---|---|---|---|
| 1,373,975 | A * | 4/1921 | Riddle | 211/41.6 |
| 1,712,342 | A * | 5/1929 | Fitzgerald | 211/41.6 |
| 2,564,478 | A * | 8/1951 | Harbison | 211/153 |
| 2,958,424 | A * | 11/1960 | Bigatti | 211/41.5 |
| 2,997,222 | A * | 8/1961 | Sperry | 211/130.1 |
| 3,193,339 | A * | 7/1965 | Cooper | 312/42 |
| 3,385,452 | A * | 5/1968 | Dantino et al. | 211/175 |
| 3,586,411 | A * | 6/1971 | Brigham | 312/351 |
| 4,726,475 | A * | 2/1988 | Ferenzi | 211/41.5 |
| 5,078,281 | A * | 1/1992 | Johnson | 211/88.01 |
| 5,083,703 | A * | 1/1992 | Blyakharov | 232/17 |
| 5,344,029 | A * | 9/1994 | Oghia et al. | 211/41.8 |
| 5,497,890 | A * | 3/1996 | Clark | 211/41.8 |
| 6,386,393 | B1 * | 5/2002 | Paulovich et al. | 222/166 |
| 6,516,956 | B2 * | 2/2003 | Martorella et al. | 211/41.6 |
| 6,880,902 | B2 * | 4/2005 | Zimmerman | 312/404 |

FOREIGN PATENT DOCUMENTS

| | | | | |
|---|---|---|---|---|
| EP | 0186157 A1 | | 7/1986 | |
| FR | 2643809 A | | 9/1990 | |
| GB | 1227798 A | | 4/1971 | |
| GB | 2042147 | * | 2/1980 | 211/41.17 |
| JP | 10024005 A | | 1/1998 | |

* cited by examiner

*Primary Examiner*—Jennifer E. Novosad
(74) *Attorney, Agent, or Firm*—Russell W. Warnock; James E. Howard

(57) ABSTRACT

A cutlery basket for use in a dishwasher. The cutlery basket receives the cutlery substantially horizontally in the dishwasher, including a base area for supporting the cutlery items. The base area having at least one pivoting articulation of a partial section of the base area that is arranged and configured with the base area in such a way that the partial section can be pivoted or lowered relative to the remaining non-pivoting section of the base area.

10 Claims, 1 Drawing Sheet

CUTLERY BASKET FOR A DISHWASHER

The object of the present invention is a cutlery basket for receiving cutlery substantially horizontally for use in a dishwasher with a base area for supporting the cutlery items.

Such a cutlery basket is known from EP 0 186 157. This dish rack is configured as a drawer and offers the possibility of receiving conventional cutlery such as knives, spoons, forks etc. and storing them in a position favourable for the effectiveness of the wash cycle. To make optimum use of the limited space in the wash container the height of the cutlery drawer is selected such according to EP 0 186 157 that spoons with a longer handle than standard cutlery can be accommodated therein without difficulty. Cutlery items of a larger size, such as for example serving cutlery, ladles or larger knives, cannot be placed in the cutlery drawer according to EP 0 186 157, because the dimensions of the cutlery items do not permit the cutlery drawer to be pushed into the dishwasher. These cutlery items must either be washed by hand, or they must be inserted into the cutlery baskets such that reliable draining of the washing liquid can also be guaranteed.

The object of the present invention is therefore to provide a cutlery basket for receiving cutlery substantially horizontally, which can also receive cutlery items of larger dimensions for washing if required, yet make optimal use of the space in the wash container if not required.

This task is solved by the inventive cutlery basket according to claim 1. Advantageous further developments of the invention are characterised in the independent claims.

The inventive cutlery basket for receiving cutlery substantially horizontally for use in a dishwasher with a base area for supporting the cutlery items in the base area has at least one pivoting articulation, which is arranged and configured such that at least a partial section of the base area can be pivoted relative to a remaining section of the base area.

According to a preferred embodiment of the invention at least one partial section of the base area of the cutlery basket can be at least lowered relative to a remaining section of the base area.

The inventive cutlery basket is advantageously configured such that the plane of the lowered partial section of the base area pushes over an angle, lying between 180° and 270°, in the plane of the remaining section of the base area.

Means are arranged appropriately on the inventive cutlery basket, which prevent unwanted lowering of the partial section of the base area over a certain mass or angle.

In using the inventive cutlery basket at least two states of the inventive cutlery basket can be distinguished. When bulk cutlery items are used they can be placed in the cutlery basket, whereby both the lowerable partial section of the base area and the remaining section of the base area lie in a plane, i.e. form an angle of 180° with one another. In this first state the dish rack offers sufficient space for the cutlery items of bulk cutlery, and also offers optimal use of the dish rack found directly underneath. In the second state the lowerable partial section of the base area can be lowered by means, so that the bulk cutlery can be inserted in the remaining section and in the partial section of the base area, and in the lowered partial section there is also enough space available for inserting cutlery items of larger dimensions, without the expectation of a collision with the wash container walls.

The means for limiting the lowering depth are arranged advantageously on a substantially side wall, attached to the lowerable partial section of the base area. The means are arranged appropriately on a substantially side wall, which is attached to the partial section of the base area.

In a particularly advantageous manner the means are supported on a corresponding area of the cutlery basket.

The present invention has succeeded in providing a cutlery basket for receiving cutlery substantially horizontally, which is required can also receive cutlery items of larger dimensions for washing, yet makes optimal use of the space in the wash container if not required.

A preferred embodiment of the present invention will be explained hereinbelow in greater detail by means of diagrams, in which.

Figure 1:
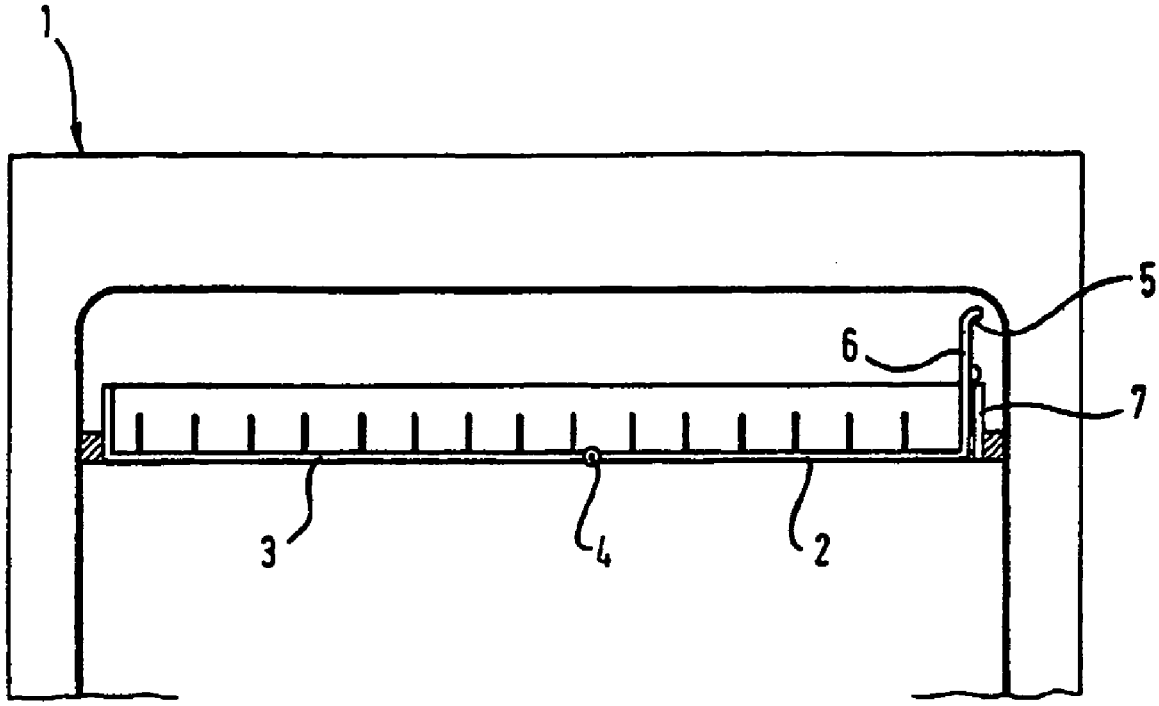
FIG. 1 is a front elevation in a dishwasher of the inventive cutlery basket in the non-lowered state.
Figure 2:
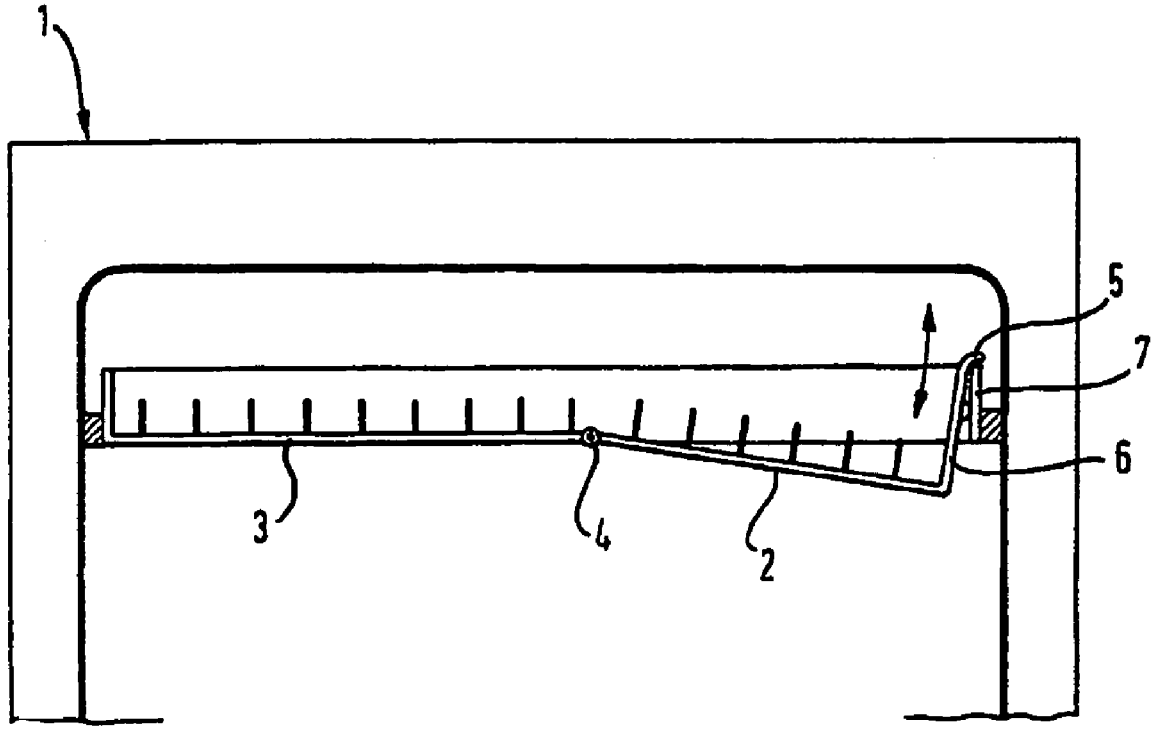
FIG. 2 shows the inventive cutlery basket according to FIG. 1 in the lowered state.

In the arrangement according to FIG. 1 a front-loading dishwasher 1 is illustrated, with an inventive cutlery basket, which has a lowerable partial section 2, a non-lowerable remaining section 3 of the base area and a pivoting articulation 4. In the state shown in FIG. 1 the inventive cutlery basket offers space for cutlery items with maximum dimensions, which is defined by the dimension between base area and wash container lid. In the arrangement according to FIG. 2 the inventive cutlery basket shown in FIG. 1 is illustrated in the swung position, corresponding to the position in the lowered state, whereby according to the present invention the partial section 2 of the base area relative to the remaining section 3 of the base area is swung by the pivoting articulation 4, i.e. is lowered, and thus registers an additional space gain in the section illustrate to the right of FIG. 2, so that serving cutlery or oversized cutlery can be introduced for example to the dishwasher for cleaning. To prevent unwanted lowering of the partial section 2 of the base area means 5, which are supported on a corresponding area 7 of the cutlery basket, are provided on a substantially side wall 6.

These means 5 are arranged and configured such that different stages, i.e. lowering depths, can easily be set. This adjusting option can be put in place for example by way of cams and detents, which are arranged on the one hand on the side wall of the lowerable partial section and on the other hand on the wall region of the remaining section.

In a particularly advantageous manner the inventive cutlery basket is made of thermoplastic material, so that the side wall or walls are configured elastically with the means arranged thereon, and are thus comfortable for the user to adjust by applying manual force.

The pivoting articulation between the lowerable partial section and the remaining section is configured appropriately such that easy cleaning or adjusting is always possible.

Alternatively, instead of means, which are arranged on a side wall of the lowerable partial section to ensure maximum lowering depth, a stop shoulder can be provided in the vicinity of the pivoting articulation or another favourable position, in which the side frame of the lowerable partial section rests positively. By way of example such a stop shoulder can be attached on the dish rack via a slide element, and the lowering depth of the partial section can be adjusted via longitudinal movement of the slide element.

When using the inventive cutlery basket at least two states of the inventive cutlery basket can be distinguished. When bulk cutlery items are used they can be placed in the cutlery basket, whereby both the lowerable partial section of the base area and the remaining section of the base area lie in a plane, i.e. form an angle of 180° with one another. In this first state the dish rack offers sufficient space for the cutlery items of bulk cutlery, and also optimal use of the dish rack located directly underneath. In the second state the lowerable partial section of the base area can be lowered by means, such that the bulk cutlery can be placed in the remaining section and in the partial section of the base area, and also in the lowered partial section there is sufficient space available to insert oversized cutlery items, without the expectation of a collision with the wash container walls.

The present invention has succeeded in providing a cutlery basket for receiving cutlery substantially horizontally, which is required can also receive cutlery items of larger dimensions for washing, yet makes optimal use of the space in the wash container if not required.

The invention claimed is:

1. A cutlery basket for use in a dishwasher, the dishwasher having a bottom, a wash container lid opposite the bottom, a pair of opposed sidewalls, a back wall, and a front access opening opposite the back wall all collectively delimiting a dishwashing cavity, the cutlery basket comprising:

a base area for supporting cutlery items, the base area having a pivot axis, a first surface section extending transversely to one side of the pivot axis to terminate at a distal portion, and a second partial section extending transversely to another side of the pivot axis to terminate at a distal portion; and a pivoting articulation, the pivoting articulation being connected to the first and second surface sections of the base area such that the first surface section of the base area is pivotable relative to the second surface section of the base area about the pivot axis, the base area being supportable within the dishwashing cavity of the dishwasher below the wash container lid of the dishwasher with the pivot axis extending through the back wall and the front access opening of the dishwasher, the distal portion of first surface section of the base area being toward one respective side wall of the dishwasher, and the distal portion of the second lateral portion of the base area being toward the other respective side wall of the dishwasher, and the pivoting articulation permitting the first surface section of the base area to pivot relative to the second surface section of the base area between a first disposition and a second disposition with the first surface section and the second surface section of the base area together forming a surface upon which items to be handled by the dishwasher can be placed in each of the first and second dispositions, the first surface section and the second surface section of the base area, in the first disposition, defining a first included angle therebetween and both the distal portion of the first surface section and the distal portion of the second surface section of the base area being at respective spacings below the wash container lid of the dishwasher, and the first surface section and the second surface section of the base area, in the second disposition, defining a second included angle therebetween smaller than the first included angle and the distal portion of the first surface section being at a closer spacing to the wash container lid of the dishwasher than in the first disposition.

2. The cutlery basket of claim 1 and further comprising a pivot stop that limits the amount of pivoting that the first surface section of the base area may be pivoted relative to the second surface section of the base area, the pivot stop engaging a respective side wall of the dishwasher.

3. The cutlery basket of claim 1 and further comprising a pivot stop that limits the amount of pivoting that the first surface section of the base area may be pivoted relative to the second surface section of the base area.

4. The cutlery basket of claim 1, further comprising an adjuster between the first surface section of the base area and a side wall of the dishwasher.

5. The cutlery basket of claim 4, wherein the adjuster comprises an elastic mechanism on the first surface section of the base area.

6. A dishwasher comprising:

a bottom;

a wash container lid opposite the bottom;

a pair of opposed sidewalls;

a back wall;

a front access opening opposite the back wall all collectively delimiting a dishwashing cavity; and a cutlery basket including (a) a base area for supporting cutlery items, the base area having a pivot axis, a first surface section extending transversely to one side of the pivot axis to terminate at a distal portion, and a second partial section extending transversely to another side of the pivot axis to terminate at a distal portion, and (b) a pivoting articulation, the pivoting articulation being connected to the first and second surface sections of the base area such that the first surface section of the base area is pivotable relative to the second surface section of the base area about the pivot axis, the base area being supportable within the dishwashing cavity of the dishwasher below the wash container lid of the dishwasher with the pivot axis extending through the back wall and the front access opening of the dishwasher, the distal portion of first surface section of the base area being toward one respective side wall of the dishwasher, and the distal portion of the second lateral portion of the base area being toward the other respective side wall of the dishwasher, and the pivoting articulation permitting the first surface section of the base area to pivot relative to the second surface section of the base area between a first disposition and a second disposition with the first surface section and the second surface section of the base area together forming a surface upon which items to be handled by the dishwasher can be placed in each of the first and second dispositions, the first surface section and the second surface section of the base area, in the first disposition, defining a first included angle therebetween and both the distal portion of the first surface section and the distal portion of the second surface section of the base area being at respective spacings below the wash container lid of the dishwasher, and the first surface section and the second surface section of the base area, in the second disposition, defining a second included angle therebetween smaller than the first included angle and the distal portion of the first surface section being at a closer spacing to the wash container lid of the dishwasher than in the first disposition.

7. The dishwasher of claim 6 and further comprising a pivot stop that limits the amount of pivoting that the first surface section of the base area may be pivoted relative to the second surface section of the base area, the pivot stop engaging a respective side wall of the dishwasher.

8. The dishwasher of claim 7, and further comprising a pivot stop that limits the amount of pivoting that the first surface section of the base area may be pivoted relative to the second surface section of the base area.

9. The dishwasher of claim 7, further comprising an adjuster between the first surface section of the base area and a side wall of the dishwasher.

10. The dishwasher of claim 9, wherein the adjuster comprises an elastic mechanism on the first surface section of the base area.

* * * * *